US009637972B2

(12) United States Patent
Miller et al.

(10) Patent No.: US 9,637,972 B2
(45) Date of Patent: May 2, 2017

(54) ROLL-UP DOOR AND GUIDE SYSTEM THEREFOR

(75) Inventors: Robert Miller, Grayson, GA (US); Michael D. Peters, West Bend, WI (US); John Whealon, West Bend, WI (US)

(73) Assignee: ASSA ABLOY Entrance Systems AB, Landskrona (SE)

( * ) Notice: Subject to any disclaimer, the term of this patent is extended or adjusted under 35 U.S.C. 154(b) by 11 days.

(21) Appl. No.: 14/424,175

(22) PCT Filed: Aug. 29, 2012

(86) PCT No.: PCT/US2012/052849

§ 371 (c)(1),
(2), (4) Date: Jun. 24, 2015

(87) PCT Pub. No.: WO2014/035388

PCT Pub. Date: Mar. 6, 2014

(65) Prior Publication Data

US 2015/0292262 A1 Oct. 15, 2015

(51) Int. Cl.
*E06B 9/58* (2006.01)
*E06B 9/13* (2006.01)
(Continued)

(52) U.S. Cl.
CPC ..... *E06B 9/58* (2013.01); *E06B 9/13* (2013.01); *E06B 9/581* (2013.01); *E06B 9/70* (2013.01); *E06B 9/80* (2013.01); *E06B 9/88* (2013.01); *E06B 2009/585* (2013.01); *E06B 2009/805* (2013.01); *E06B 2009/885* (2013.01)

(58) Field of Classification Search
CPC . E06B 9/58; E06B 9/581; E06B 9/585; E06B 9/80; E06B 9/70; E06B 9/88; E06B 9/13; E06B 2009/885; E06B 2009/805
See application file for complete search history.

(56) References Cited

U.S. PATENT DOCUMENTS 4,467,853 A * 8/1984 Downey, Jr. ..... E06B 9/15 160/133
4,649,981 A 3/1987 Bibeau
(Continued)

FOREIGN PATENT DOCUMENTS

DE 2005043796 * 3/2007
DE 102005043796 * 3/2007
(Continued)

*Primary Examiner* — Blair M Johnson
(74) *Attorney, Agent, or Firm* — Haug Partners LLP

(57) ABSTRACT

A roll-up type industrial door including a flexible sheet or woven fabric forming a curtain for closing a door way having an upper end, a lower end and two opposite side edges. The sheet has a main area and elongate side edge sections that are thicker than the main area. A shoulder is formed where each side edge section meets the main area. A curtain winding mechanism is connected to the upper end of the curtain and is used to raise the curtain. A pair of spaced apart guide channels are also provided and the side edge sections are movable therein. Each guide has one or two elastic members which act as locking blades. The locking blades of each guide form an elongate slot that receives a side edge section of the curtain.

28 Claims, 11 Drawing Sheets

(51) Int. Cl.

| | |
|---|---|
| ***E06B 9/70*** | (2006.01) |
| ***E06B 9/80*** | (2006.01) |
| ***E06B 9/88*** | (2006.01) |

(56) References Cited

U.S. PATENT DOCUMENTS

| | | | | |
|---|---|---|---|---|
| 5,445,209 | A * | 8/1995 | Lichy | E06B 9/13 160/273.1 |
| 5,482,104 | A * | 1/1996 | Lichy | E06B 9/13 160/273.1 |
| 5,964,270 | A * | 10/1999 | Kirkey | E06B 9/13 160/264 |
| 7,028,741 | B2 * | 4/2006 | Coenraets | E06B 9/13 160/271 |
| 7,516,770 | B2 | 4/2009 | Jerry | |
| 2003/0106648 | A1 * | 6/2003 | Lancina | E06B 9/17076 160/41 |
| 2005/0016695 | A1 | 1/2005 | Thompson | |
| 2009/0229767 | A1 * | 9/2009 | Mullet | E06B 9/581 160/26 |
| 2010/0236729 | A1 * | 9/2010 | Fischer | E06B 9/88 160/318 |
| 2012/0012262 | A1 * | 1/2012 | Santoro | E06B 9/42 160/272 |
| 2013/0306252 | A1 * | 11/2013 | Lambridis | E06B 9/13 160/133 |
| 2015/0292262 | A1 * | 10/2015 | Miller | E06B 9/13 160/270 |

FOREIGN PATENT DOCUMENTS

| | | | |
|---|---|---|---|
| EP | 1522672 | * | 4/2005 |
| EP | 1522672 A1 | * | 4/2005 |
| FR | 1379077 | * | 11/1964 |
| FR | 2839740 | * | 11/2003 |
| WO | WO 99/02812 A | | 1/1999 |

* cited by examiner

ROLL-UP DOOR AND GUIDE SYSTEM THEREFOR

This application is a 371 of PCT/US2012/052849 filed on Aug. 29, 2012, published on Mar. 6, 2014 under publication number WO 2014/035388.

FIELD OF THE INVENTION

This invention relates to roll-up doors intended for use in industrial and commercial buildings and structures and, in particular, to roll-up doors that include a flexible sheet forming a curtain for closing a doorway and a pair of spaced apart guide channels in which side edge sections of the curtain are respectively movable.

BACKGROUND OF THE INVENTION

Since the 1970's there has been a great need to use rapidly moving doors in buildings for industrial use, collectively referred to as industrial doors. This applies to openings indoors as well as in external walls, where the door provides shielding between different activities or prevents drafts and heat losses. It is well known in the door industry to provide a flexible, roll-up door that can be used to provide a passageway barrier in industrial, commercial, mining and other such facilities to accommodate the access of trucks, trains, forklifts and other such equipment to the facility or building or to provide passageway barriers within the facility or building.

Roll-up doors formed with flexible door leaves are often used for this purpose, but more rigid constructions like slatted doors with polymeric or metallic lamellae are also used. In one known example, these doors are rolled up on an overhead drive cylinder or on two independently driven disks and can be provided with additional elements like transverse wind reinforcements on the door leaf to counteract wind load, a weight balance system, tensioning system, windows or the like. For safety reasons, roll-up doors can be further provided with safety edge protection, failsafe devices, drop protection, and crash safety functions.

A flexible roll-up door typically consists of a synthetic rubber or fabric curtain, or belting panel material, which acts as a barrier across the passageway. The curtain is attached across its top edge to a rigid metal drum spanning the width of the passageway. This metal drum is typically known as a drive barrel and is equipped with a solid steel shaft at both ends. Each of the two steel shafts are supported by a flanged type bearing attached to a steel plate, typically known as an endplate, which is attached to the side frames or building structure directly around the passageway. Applying a controlled rotational movement of the drive barrel results in the curtain spooling onto the drive barrel, thus retracting the curtain upward to expose the passageway. Also, it may be inversely spooled off the drive barrel to dispense the curtain downward and close off the passageway.

The lower, horizontal perimeter or bottom of the curtain is reinforced with structural steel members to provide rigidity to the section of curtain edge making contact with the ground. This component of a flexible roll-up door is typically known as a bottom bar and must be of sufficient rigidity to maintain adequate straightness of the curtain for the operation of the door. The bottom bar is configured to a predetermined mass to provide adequate gravitational force to pull the curtain to the ground. The bottom bar may include reversing, safety and/or sealing devices mounted thereon.

The two vertical perimeters or edge sections of the curtain usually travel within suitable enclosures mounted adjacent to the passageway on each side. This component is typically known as a guide and serves the purpose of maintaining the required position of the vertical edge of the curtain while permitting unrestricted travel during door operation. The curtain is most often configured along its vertical edges with appropriate components, hereto referred to as curtain locks, to mate with the guides. Many flexible roll-up doors are constructed so that a predetermined releasing force can-cause the curtain to disengage itself from the guide or guides, for example, when the curtain is impacted by a vehicle or other device. The curtain is both retracted by and dispensed from the drive barrel over the forward side of a horizontal, rigid steel pipe spanning the width of the passageway. This pipe is located above the passageway and in close proximity to the building structure to provide an upper horizontal perimeter seal to the passageway and further serves as a curtain positioning mechanism, aligning the curtain with the guides mounted to the vertical sides of the passageway. This steel pipe is typically known as an idler barrel and is equipped with a solid steel shaft at both ends. Each of the two steel shafts are supported by a flange type bearing attached to its respective mounting angle.

The known flexible roll-up door systems can also include various other components to complete their functionality such as a counterbalance system, often through the use of torsion springs and/or weights, an operating mechanism that may consist of a manual hoist and/or electric motor with gear and/or chain power transmission arrangement, along with other secondary components. Known roll-up doors are commonly equipped with a curtain that has an element or elements attached to the vertical edges of the curtain (forming a curtain lock or windlocks) that co-operate with fabricated, often elaborate, guide assemblies. U.S. Pat. No. 7,516,770, U.S. Pat. No. 5,445,209, and U.S. Pat. No. 5,482,104, for example, disclose roll-up door systems with such guide assemblies.

As disclosed in these patents, it is desirable to provide a structure which enables the side edges of the flexible curtain to separate from the guide structure in the event the flexible curtain is subjected to an excessive impact force such as a vehicle striking the door but withstand wind or air pressure without disengagement from the guide. Flexible roll-up doors with continuous windlocks can retain the door panel horizontally inside the guides and provide a seal. However, these windlocks become wedged in rigid guides if the force is too great and cannot be laterally reinserted without an even greater force, special tools, or partial or full disassembly of the structure. The structures resisting the pull-out force of the flexible door panel are also designed to require rigidity and minimize deflection in all components such that elastic deformation in the support frames, usually metal, must occur in order to allow the flexible panel windlocks to dislodge.

This problem has typically been solved by either fully or partially disassembling the rigid vertical guide system to dislodge or reduce the force on the windlocks, or by using segmented, relieved, or non-continuous windlocks. Some designs have used discrete, incrementally located, rigid or semi-rigid fasteners attached to the flexible curtain. In all known cases, however, reinsertion of the flexible panel and windlocks into their normal state in the vertical guide is prevented horizontally by design.

SUMMARY OF THE INVENTION

One aspect of the present invention provides for a guide system which guides the side edges of the flexible curtain, enables the side edges to separate from the guide structure upon excessive impact force, and enables the side edges of the curtain to be easily reinserted into the guide structures thereby avoiding damage to the flexible curtain in the event of excessive impact forces engaging the flexible curtain.

It is an object of one aspect of the present invention to provide a roll-up door that can be manufactured more easily and at lesser cost than previously known flexible rubber or fabric roll-up doors. It is an object of another aspect of the present invention to provide an elongate guide for use with a roll-up type door which can be manufactured relatively easily at a reasonable cost and which is capable of engaging a curtain with opposing locking blades in a manner so that the guide is capable of engaging both front and back sides of the door curtain simultaneously.

It is an object of another aspect of the present invention to provide a vertically opening and closing flexible door or curtain provided with a guide structure along the side edges of the door opening with cooperating structure on the side edges of the flexible curtain and on the guide structure to facilitate vertical movement of the flexible curtain, provide a single or double windlock at the side edges of the flexible curtain and enable the side edges of the flexible curtain to be disengaged from the guide structure in the event of excessive impact force on the flexible curtain and enable the side edges of the flexible curtain to be quickly and easily reinserted into the guide structure after disengagement therefrom.

A further object of one aspect of the invention is to provide a guide system for a flexible curtain which includes a guide channel having one or two opposing locking blades associated with a windlock or windlocks on the edge of the flexible curtain to enable separation of the curtain from the guide channel without damage to the curtain or the guide channel in the event of an excessive impact force coming into contact with the curtain.

A still further object of one aspect of the invention is to provide a guide system in accordance with the preceding objects in which the guide structure is provided with guides such as locking blades(s) and the door being either a roll up door or a full vertical lift door and the windlocks being one or two substantially continuous narrow strips along each side edge of the curtain.

A further object of one aspect of the invention is to provide a guide system with significantly reduced size, weight, and cost, and to provide an equivalent or increased level of performance compared to traditional or current designs.

A further object of one aspect of the invention is to provide a guide system that can be easily incorporated in new and existing door structures without a need for significant restructuring.

According to one aspect of the invention, a roll-up door comprises a one-way bearing functionality to the vertical guide system such that the flexible panel with a continuous windlock is allowed to freely travel vertically with minimal resistance, and can provide a continuous vertical seal. The vertical guide assembly provides increasingly heavier resistance to horizontal deflection of the flexible panel and windlock that would dislodge it from the vertical guide in order to retain it in a normal condition under air pressure or impact forces. With excessive forces, the vertical guide allows for release or partial release of the windlock assembly prior to damage occurring to either or any members. In this partially dislodged position, forces resisting vertical movement of the flexible panel are minimized by the allowed deflection of the locking blade, a relatively highly elastic member within the vertical guides, as opposed to the rigid vertical guide or flexible windlock material itself.

According to another aspect of the invention, a roll-up door comprises a one-way bearing that easily allows the flexible panel with continuous windlock to be reinserted, or to reinsert itself into the vertical guide upon vertical motion of the flexible panel with a minimal amount of resistance. This method allows for such a flexible door to provide a high pressure resistance to dislodging from the guides along with a continuous weather seal at the same time as having the ability to repair or heal itself automatically without the need for tools or manual manipulation or disassembly of components. The increasing resistance to pull-out force is achieved by the unidirectional bearing action of the locking blade or elastic member, instead of relying on stiffness or rigidity of the vertical guide itself.

BRIEF DESCRIPTION OF THE DRAWINGS

The following description, given by way of example and not intended to limit the invention to the disclosed details, is made in conjunction with the accompanying drawings, in which like references denote like or similar elements and parts, and in which.

DETAILED DESCRIPTION

Embodiments of the invention are described below with reference to the accompanying drawings which depict different embodiments. However, it is to be understood that application of the invention encompasses other uses for the invention in applications involving rollup doors. Also, the invention is not limited to the depicted embodiments and the details thereof, which are provided for purposes of illustration and not limitation.

Figure 5:
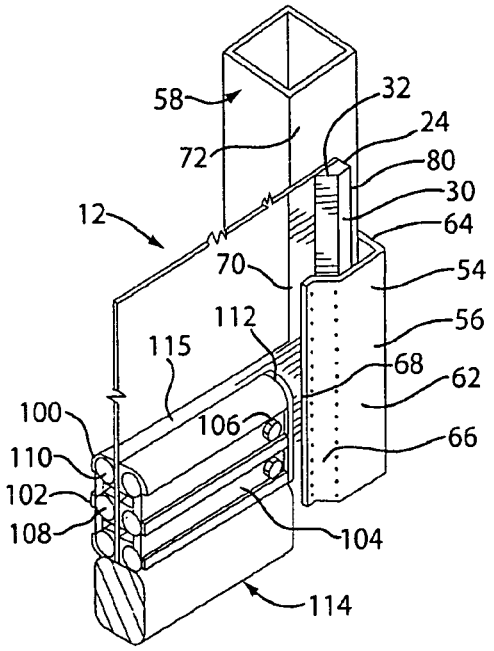
FIG. 5 is a detail perspective view showing a bottom right hand corner of the door assembly of FIG. 2.

A roll-up door or door assembly 10 constructed in accordance with the present invention includes a flexible sheet 12 forming a curtain for closing a doorway 14 which may be provided in a wall 16 of a building or other structure. Often a roll-up door 10 of this type is used in a commercial or industrial building and commonly it is used to open and close an interior or exterior doorway. The curtain has an upper end 18, a lower end 20 and two opposite side edges 22 and 24. The sheet 12 has a main area 26 which covers most of the sheet and two elongate side edge sections 28 and 30 which, as can be seen from FIG. 5, are thicker than the remainder of the sheet. A sloping shoulder 32 is formed where each side edge section meets the main area 26 or, in other words, the shoulder 32 is formed on the exposed side of the side edge section which is adjacent the main area.

In a manner known per se, the upper end 18 of the curtain is mounted to a rotatable curtain roll or drive barrel 34 which is part of a curtain winding mechanism used to raise and lower the curtain. The curtain winding mechanism also includes an electric door operator 36. The operator includes an electric motor 38 which is connected by means of a drive chain 40 to a door sprocket 42. Electric lines (not shown) connect the electric door operator to a wall mounted push button control panel 44. As the curtain winding mechanism is of known construction, a detailed description thereof herein is deemed unnecessary. In order to improve the appearance of the assembly, the drive barrel 34 can be partially or wholly enclosed by a hood 46.

The flexible door curtain 12 is rolled around the horizontal drive barrel 34 that extends across the top of the door opening 14. The roll 34 has a shaft section 48 projecting outwardly from each end, each section being rotatably mounted in a suitable bearing mounted on a support bracket 50.

According to one embodiment of the present invention, the roll-up door 10 includes a pair of spaced apart guide channels 52, 54 in which the side edge sections 28, 30 are respectively movable. These side edge sections are engageable with the guide channels 52, 54 and are normally held therein as explained in more detail hereinafter.

According to one exemplary embodiment of the present invention, each guide channel includes an elongate, metal front plate 56 and an elongate metal rear guide member 58 which is in the form of a tubular member having a generally square or rectangular horizontal cross-section. The front plate 56 is detachably connected to the rear guide member 58 if desired by means of washers and bolts 59. The guide members 56, 58 can be made of steel or preferably aluminum. In a known manner per se, the rear guard member 58 is connected to the adjoining wall 16, such as by mounting bolts (not shown). Both guide members extend at least the height of the doorway 14 (and preferably higher than the existing lintel) and their bottom ends are located adjacent the floor or ground surface 60. The illustrated preferred front plate 56 includes longitudinally extending front leg 62 and a side leg 64 which extends perpendicular to the front leg and is connected to the rear guide member 58.

According to one embodiment of the present invention, a narrow throat 70 is formed between the inner edge of the 156 and rear guide member 158. The curtain or sheet 12 extends through the throat 70 formed by each guide channel. As can be seen clearly in FIG. 6, each side edge section 28, 30 has a total thickness (measured in a direction perpendicular to the front side 72) which is greater than the width of the throat 70 so that each thicker side edge section 28, 30 is normally trapped in its respective guide channel.

Figure 6:
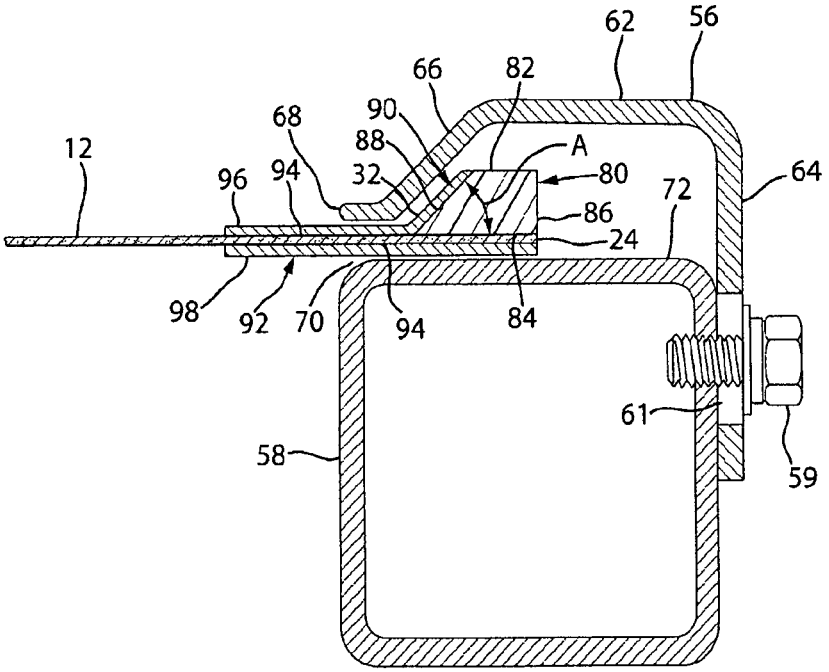
FIG. 6 is a horizontal cross-sectional view providing details of a prior art guide channel and an edge section of the door curtain.

Preferably, the thicker side edge section is made with the use of an elongated styrene butadiene rubber (SBR) member which is bonded to the rubber sheet of the curtain 12. The preferred rubber or SBR member 80 has a substantially uniform transverse cross-section having the shape of a trapezoid. Each rubber member 80 has a front or outer surface 82 which is parallel to a wider, rear surface 84. The surface 84 is bonded to the thin rubber sheet of the curtain by means of a cold bond glue. Another side 86 of the rubber member extends perpendicular to the sheet 12 and perpendicular to surfaces 82 and 84. The sloping shoulder 32 is formed on a fourth side 88 of the rubber member. The sloping side 88 is covered by means of a friction reducing, wear resistant fabric strip 90 which is bonded to the respective side edge section of the curtain. As illustrated in FIGS. 5 and 6, preferably there is a further elongate wear-resistant fabric strip 92 bonded to the side of the curtain 12 opposite the rubber member 80. The two fabric strips 90 and 92 extend along the side edge section in a direction parallel to the adjacent side edge 22 or 24 of the curtain. The strips 90 and 92 reduce the amount of friction between their respective side edge section and the guide channel 52 or 54.

In a particularly preferred embodiment, each fabric strip 90, 92 is made of one ply polyester monofilament. In order that the fabric strip can be readily attached to the rubber sheet 12, the fabric strip is coated with styrene butadiene rubber (SBR) on one side. This one side indicated at 94 is the side bonded to the respective side edge section of the curtain. Preferably, each of the fabric strips 90 has an inner longitudinal section 96 that covers a narrow section of the thin main area of the sheet 12 and is bonded thereto. It will be appreciated that the inner edge 68 of the front plate will tend to rub against the section 96 of the strip and thus the section 96 prevents wear on the sheet 12 arising from long term use of the door. It will be further understood that the second fabric strip 92 serves to reduce the friction between the side edge section of the door and the rear guide member 58.

Figure 4:
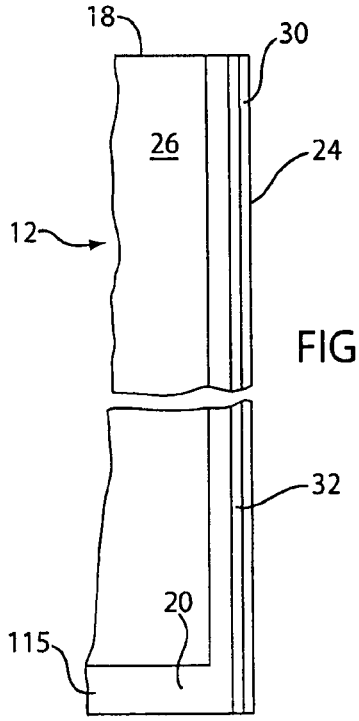
FIG. 4 is a partial cut-away front view of the door curtain used in the door assembly of FIGS. 1 and 2.

In a particularly preferred embodiment, each of the fabric strips 90, 92 can be quite thin and can have a thickness of only about 1.0 mm. Each fabric strip has a glossy outer side 98 for friction reducing purposes. In one preferred embodiment of the door, each of the fabric strips 90, 92 extends substantially from the upper end 18 of the sheet 12 to the lower end 20 as illustrated in FIG. 4. Thus the strip 90 covering the sloping shoulder forms a long, substantially continuous, friction-reducing surface extending lengthwise along the sloping shoulder. However, it is also possible for the fabric strips to be provided as spaced apart vertically extending strip sections with the gap between adjacent ends of the strip sections being as much as four inches. The length of the individual strip sections can be as long as desired, but the sections should not be so short as to result in any undesirable wear on the main sheet 12 of the curtain.

Although the degree of slope of the sloping shoulder can vary, in a particular preferred embodiment of the door, the shoulder 32 slopes outwardly from the transverse centre of the curtain at an angle A of about 45 degrees to the main area of the curtain, this preferred angle being indicated in FIG. 6. Preferably, the angle A of the shoulder is between about 30 to about 45 degrees to the main area of the curtain. It will be appreciated that each side edge section 28, 30 is intended to release under an impact force from its respective guide channel and both the angle A of the sloping shoulder and the fabric strips 90, 92 helps in the release of the side edge section. The angle A must not be so great as to prevent the required release of the side edge section from the channel when the curtain is struck without serious damage to the curtain. Similarly the angle A should not be so small that the side edge section will come out of the channel too easily. There is also a danger if the angle A is quite small that the side edge section could become inadvertently wedged in the throat 70 as a result of ordinary operation of the door or wind or air pressure acting on the door. Also, to assist in the release of the side edge section under an impact force, the front plate 56 is provided with the aforementioned sloping inner edge portion 66, the slope of this portion preferably corresponding to the slope of the shoulder 32. Thus, in a particular preferred embodiment, the slope of the portion 66 is 45 degrees to the flat surface of the curtain 12.

In a known manner per se, the flexible sheet or curtain 12 is provided with a rigid bottom bar 100 which is attached to the lower end 20 of the curtain and which extends almost the entire width of the curtain, not including the curtain's side edge sections. The illustrated preferred bottom bar comprises two extruded aluminum, elongate bar members 102 and 104 located on opposite sides of the sheet 12. The two bar members are connected together by means of nuts and bolts 106 which are distributed in pairs along the length of the bar members (see FIG. 2). Preferably the weight of the bottom bar 100 can be varied using weights 108 mounted in or on each bar member. As illustrated in FIG. 5, each bar member 102, 104 is formed with several, for example three, elongate cylindrical cavities 110 capable of receiving a number of the weights 108. The weights 108, which may comprise elongate metal rods are inserted into the cavities 110 in order to adjust the total weight of the bottom bar to a desired weight. This desired weight may, for example, depend upon the size of the door and in particular the height thereof. It will be appreciated that a bottom bar of appropriate weight is important to the proper operation of the roll up door since the curtain should have a stretching force acting thereon as it is being raised and lowered. The stretching force helps to maintain the side edge sections in the channels and helps to prevent possible binding of the side edge sections in the channels during operation of the door. If the bottom bar 100 is struck accidently, it will act to pull the thickened curtain edges from the guide channels. Preferably each end of each bar member is provided with a suitable plastic end cap 112 which closes the ends of the cavities 110. Also, as is well known, a safety edge strip 114 should extend along the bottom of the bottom bar 100. The construction of the safety edge strip is well known and need not be described in detail herein. The purpose of the safety edge strip is to prevent the door from closing on a person or object in the doorway, the strip 114 acting to cause the roll-up door to reverse direction and open if the member 114 strikes an object or person.

In one preferred embodiment of the door and as illustrated in FIG. 5, a reinforcing, wear resistant fabric strip 115 extends across the bottom of the sheet 12 on each side of the curtain. The strip 115 is positioned between the bar member 102 or 104 and the sheet 12 and helps to prevent the sheet 12 from being damaged in the event that the bottom bar is struck by strengthening the bottom end portion of the curtain.

In one preferred embodiment of the door, the main area of the curtain 12 has a thickness of 16th inch. A preferred form of this thin sheet for the curtain is sold under the trade-mark DUROTEX. In this preferred embodiment, the SBR member 80 has a width measured along the wide side 84 of 1 inch and a thickness of ½ inch. It will be appreciated that instead of SBR, the member 80 can be made of other suitable flexible materials such as PVC, rubber or synthetic rubber.

Figure 1:
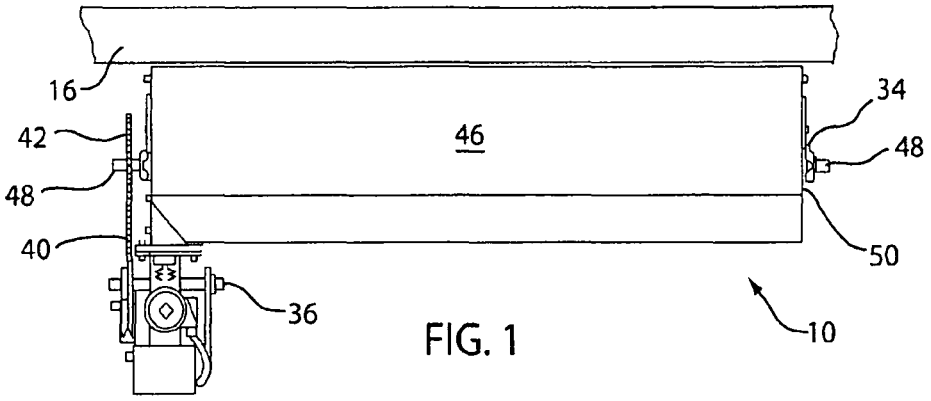
FIG. 1 is a top view of a roll-up door constructed in accordance with the invention, this door being mounted in a doorway formed in a wall.
Figure 2:
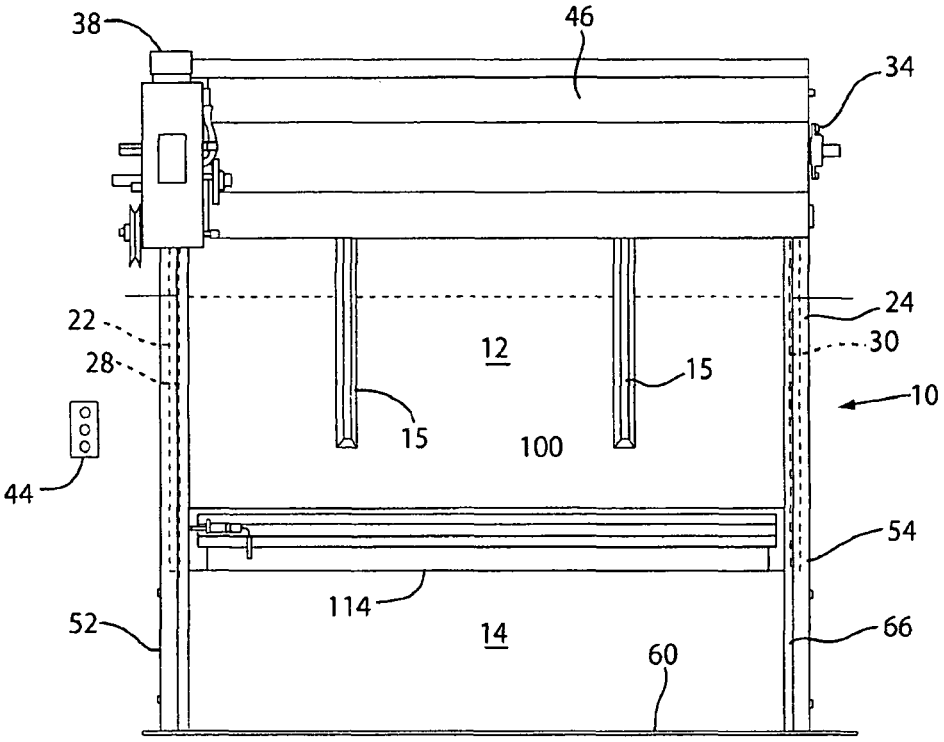
FIG. 2 is a front elevation of the roll-up door of FIG. 1, the door being shown in a partially open position.
Figure 3:
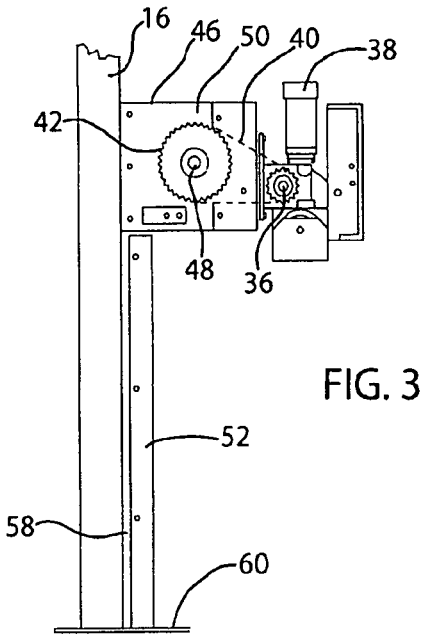
FIG. 3 is a left side view of the roll-up door of FIGS. 1 and 2.

The illustrated roll-up door is provided with two, vertically extending roll strips 15 provided on one side of the curtain as shown in FIG. 2. These strips assist the operation of the door by enabling it to track properly. In other words, these strips tend to keep the curtain rolling evenly. They have the same thickness, i.e. ½ inch, as the members 80 on the door edges and can be made of the same SBR material.

Figure 7:
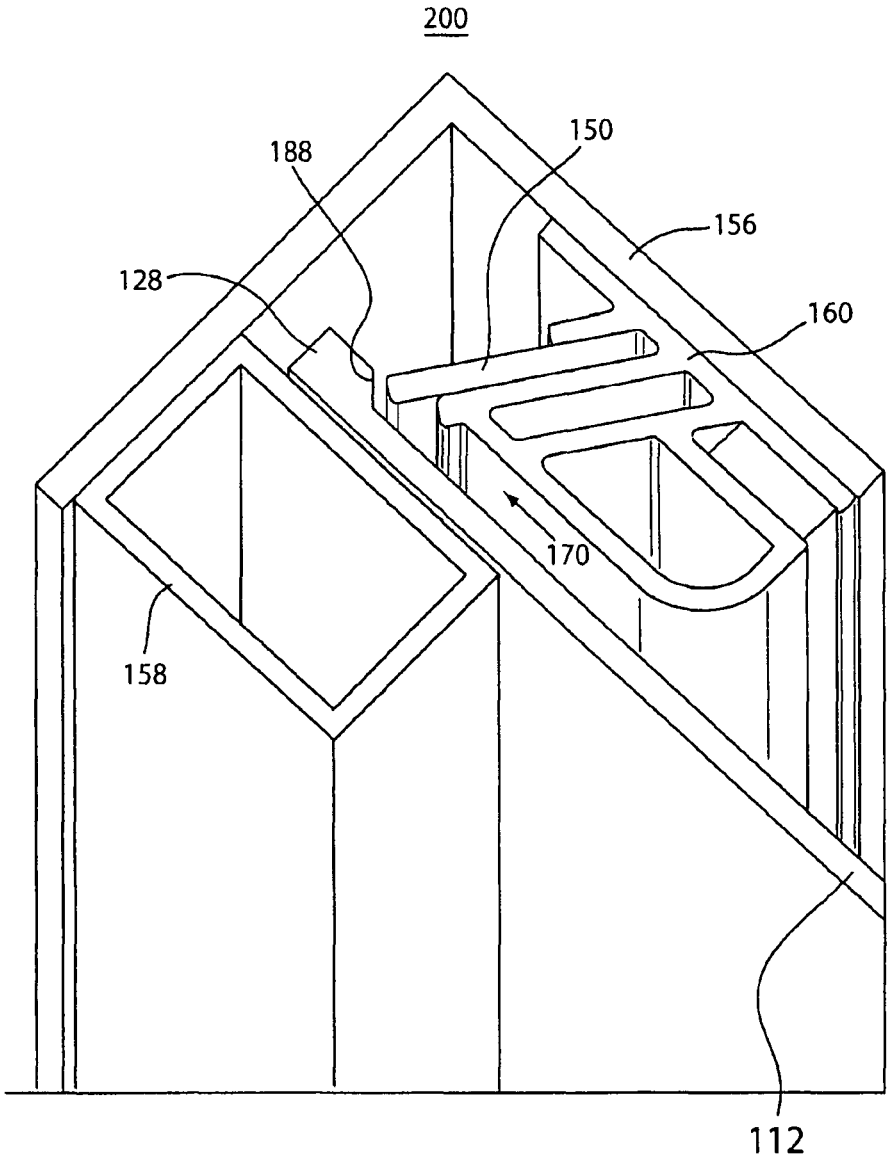
FIG. 7 is a schematic showing horizontal cross-sectional view of a guide channel and an edge section of the door curtain, according to one aspect of the present invention.

Turning now to FIG. 7, one-way bearing guide system 200, according to one embodiment of the present invention, includes a guide member 158 to which is attached a second guide member 156. The guide system 200 includes a gripping bracket 160, which holds in place angled locking blade(s) 150, which will be described in more detail in the later paragraphs. Guide system 200 guides curtain 112, which can be of rubber or fabric belting panel material. The curtain itself can be a rubber or fabric belting panel material described in the previous embodiments. The guide members 156, 158 as well as the gripping bracket 160 can be brackets that can be made of a metal, such as steel or aluminum. Alternatively, the guide members 156, 158 and/or gripping bracket 160 can be an extrusion made of epoxy or a polymeric resin material. The guide members 156, 158 and the gripping bracket 160 can be held together using hardware, such as washers, bolts, nuts, and screws, which are generally referred to as 159 in the figures.

Figure 8:
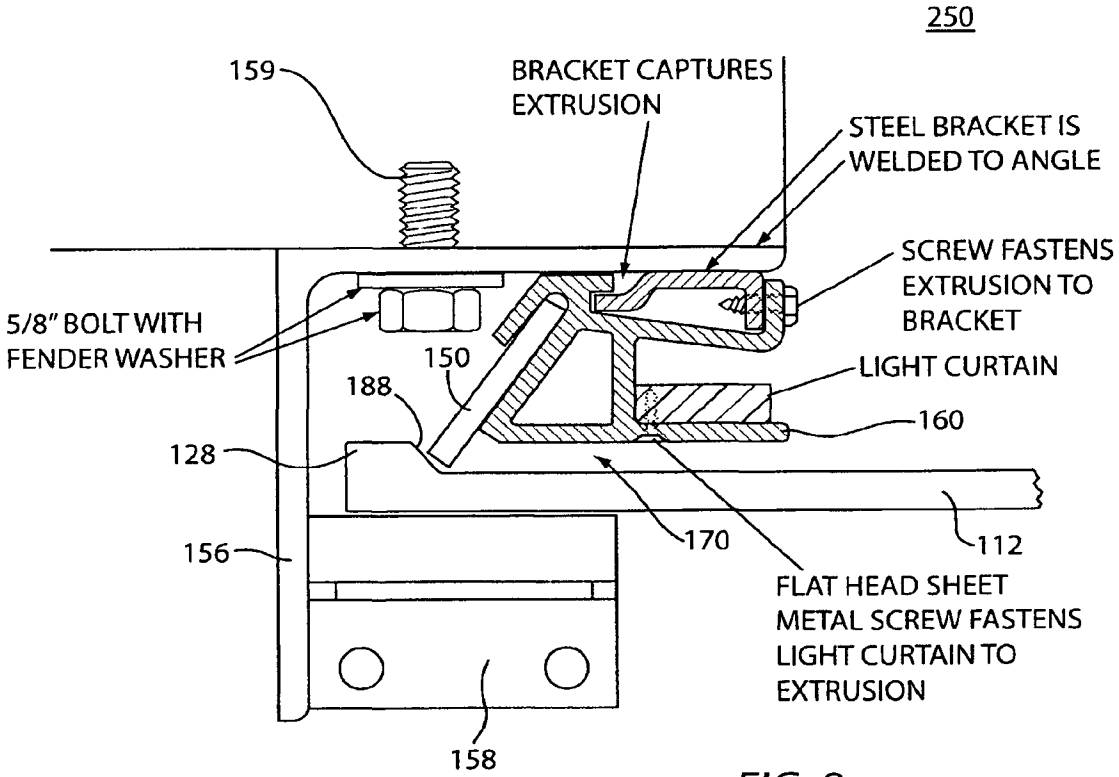
FIG. 8 is a schematic showing horizontal cross-sectional view of a guide channel and an edge section of the door curtain, according to one aspect of the present invention.

According to one embodiment of the present invention, the guide system 200 includes a locking blade 150, which can be one or more layers of a single or multi-ply door fabric. The locking blade can be made of rigid or semi-rigid polymers such as polyethylene, polypropylene, polyurethane, nylon or other such polymers. The fabric itself can be made of Nylon, PVC or any other suitable material, and can be impregnated with a polymeric resin or rubber on one or both sides. Gripping bracket 160 holds the locking blade 150 in such a manner that it is at an angle to the edge 128 of the sheet 112, and such that it is substantially tangential to the surface 188 of the edge portion 128, resisting the curtain 112's exit from throat portion 170. As shown in FIGS. 7 and 8, gripping bracket 160 extends along a major portion of the side of blade 150 facing outward of the guide, thus resisting deflection of the blade in response to forces pulling the curtain 112 minor portion of the side of blade 150 facing into the guide, thus allowing the blade to deflect inward when curtain 112 needs to be inserted into the guide.

The guide system 250, according to one embodiment of the invention, can include additional brackets, as shown in FIG. 8, for example. The additional brackets help secure the guide system 250 in place, and can provide additional ruggedness to the system.

Figure 9:
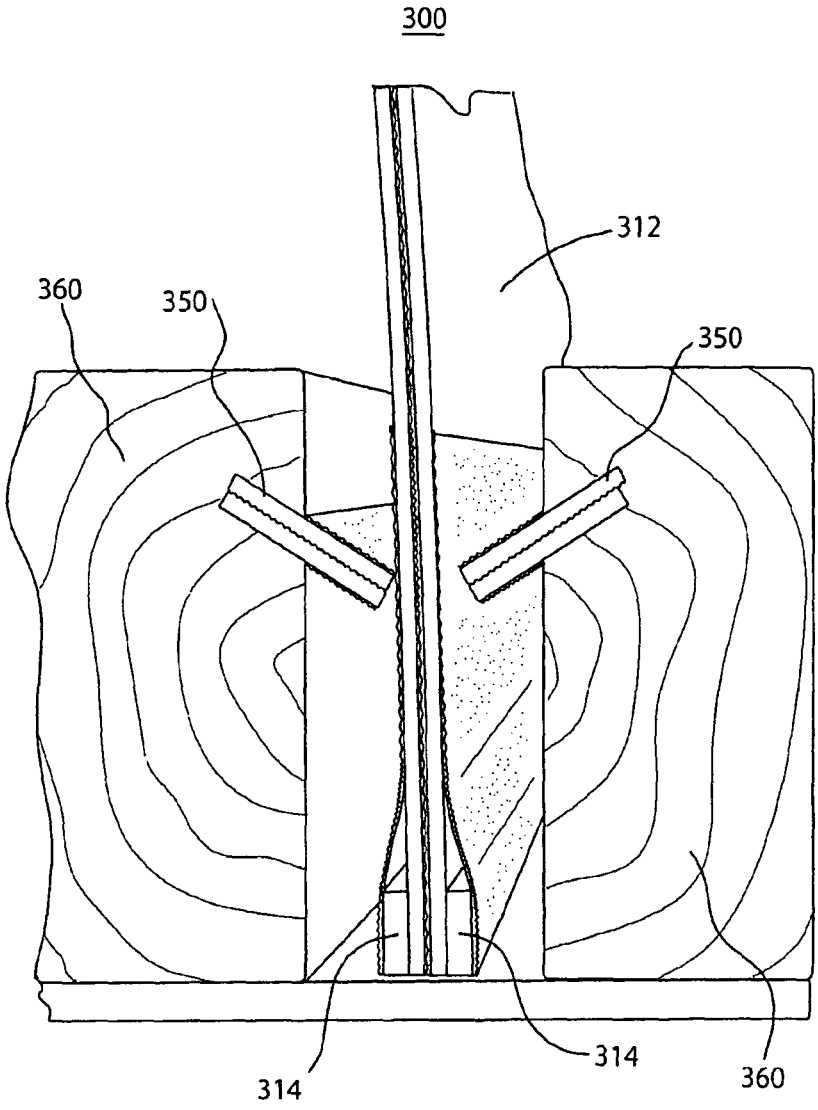
FIG. 9 is a photograph showing horizontal cross-sectional view of an exemplary guide channel and an edge section of the door curtain, according to one aspect of the present invention.

The roll-up door 300, according to one embodiment of the invention, includes a sheet or curtain 312 with double sided windlocks 314 and two-way bearing system, as shown in FIG. 9, for example. However, the locking mechanism can be similar to the one described in the above embodiment.

Roll-up door system 300 uses two angled blades 350 instead of one. Both, the angled blades 350 as well as the sheet or curtain 312 can be constructed as described in the previous embodiments. However, the present embodiment requires two gripping brackets 360 in order to secure the angled blades in their respective positions. Angled blades 360 guide the sheet 312 during its normal operation, and resist its exit at impact.

Figure 10:
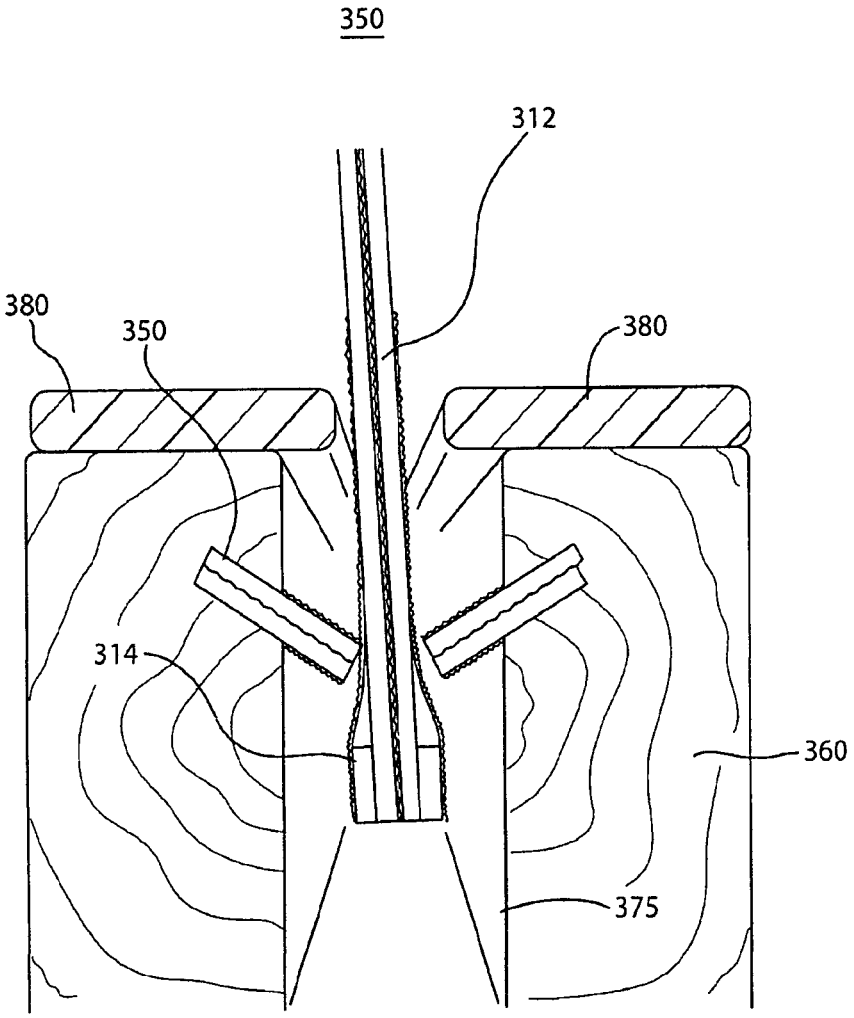
FIG. 10 is a photograph showing horizontal cross-sectional view of an exemplary guide channel and an edge section of the door curtain, according to one aspect of the present invention.

The roll-up door 350, according to one embodiment of the invention, can include Nylon guides 380 to keep the door pullout as parallel as possible to the flat surfaces 375 of the gripping brackets 360, as shown in FIG. 10, for example. Roll-up door 350 includes a sheet or curtain 312 with double sided windlocks 314. However, the locking mechanism can be similar to the one described in the above embodiment. Roll-up door system 300 uses two angled blades 350 instead of one. Both, the angled blades 350 as well as the sheet or curtain 312 can be constructed as described in the previous embodiments. However, the present embodiment requires two gripping brackets 360 in order to secure the angled blades in their respective positions. Angled blades 360 guide the sheet 360 during its normal operation, and resist its exit at impact.

Figure 12:
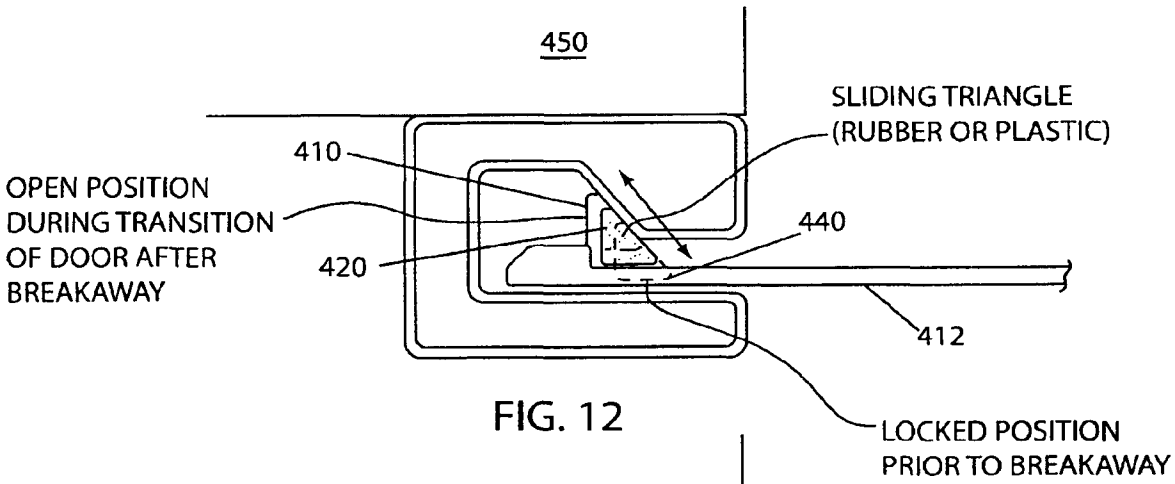
FIG. 12 is a schematic showing horizontal cross-sectional view of a guide channel and an edge section of the door curtain, according to one aspect of the present invention.
Figure 11:
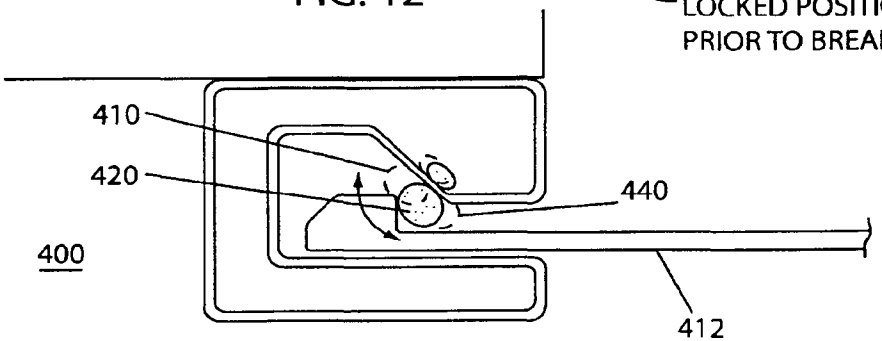
FIG. 11 is a schematic showing horizontal cross-sectional view of a guide channel and an edge section of the door curtain, according to one aspect of the present invention.

An exemplary guide system 400, according to one embodiment of the invention, can include a sliding member 420, as shown in FIGS. 11 and 12, for example. Sliding member 420 can be made of rubber or plastic, and can be used to resist exist of curtain 412 at impact. Sliding member 420 can be in circular form as shown in FIG. 11, for example, and move between an open position 410, moving position 430, and locked position 440, as shown in FIG. 11, for example.

Alternatively, sliding member 420 can be in a triangular form as shown in FIG. 12, for example, and move between an open position 410, moving position 430, and locked position 440, as shown in FIG. 12, for example.

Figure 13:
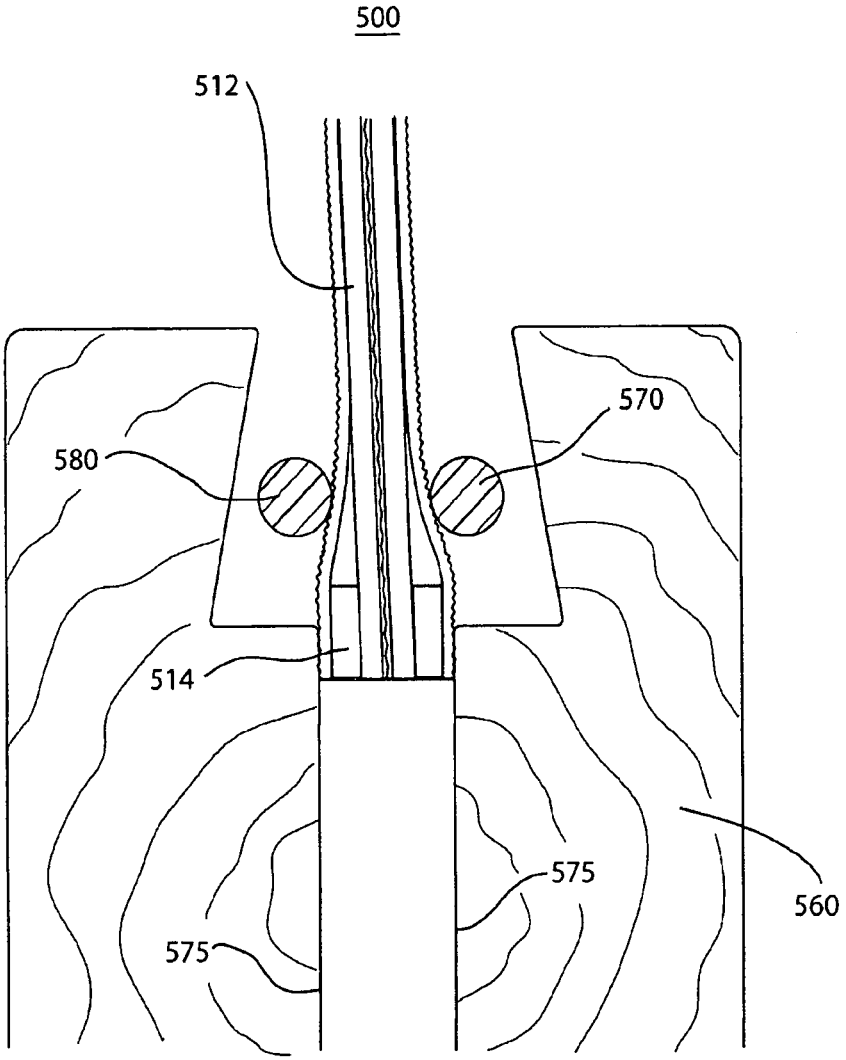
FIG. 13 is a photograph showing horizontal cross-sectional view of an exemplary guide channel and an edge section of the door curtain, according to one aspect of the present invention.

The roll-up door 500, according to one embodiment of the invention, can include a two-way bearing system including Nylon rollers 580 to keep the door pullout as parallel as possible to the flat surfaces 575 of the gripping brackets 560, as shown in FIG. 13, for example. Roll-up door 500 includes a sheet or curtain 512 with double sided windlocks 514. However, the locking mechanism can be similar to the one described in the above embodiment. The sheet or curtain 512 can be constructed as described in the previous embodiments. However, the present embodiment requires two rubber covered angled surfaces 570 in order for the rollers 580 to act as bearings.

It should be noted that the angled blades in the above described embodiments can have a thickness of 0.1 to 4 inches, or more, and can have a width of 0.25 to 4 inches, or more. The length of these blades can be equivalent to the height of the door, or more. It should also be noted that the width of the sheet or curtain in the above described embodiments can be anywhere between 5 and 50 feet or more, and the height of the same sheet or curtain can be anywhere between 5 and 35 feet or more. However, it may be apparent to one of ordinary skill in the art to use sheets or curtains of other sizes with the guide systems described herein.

Figure 14:
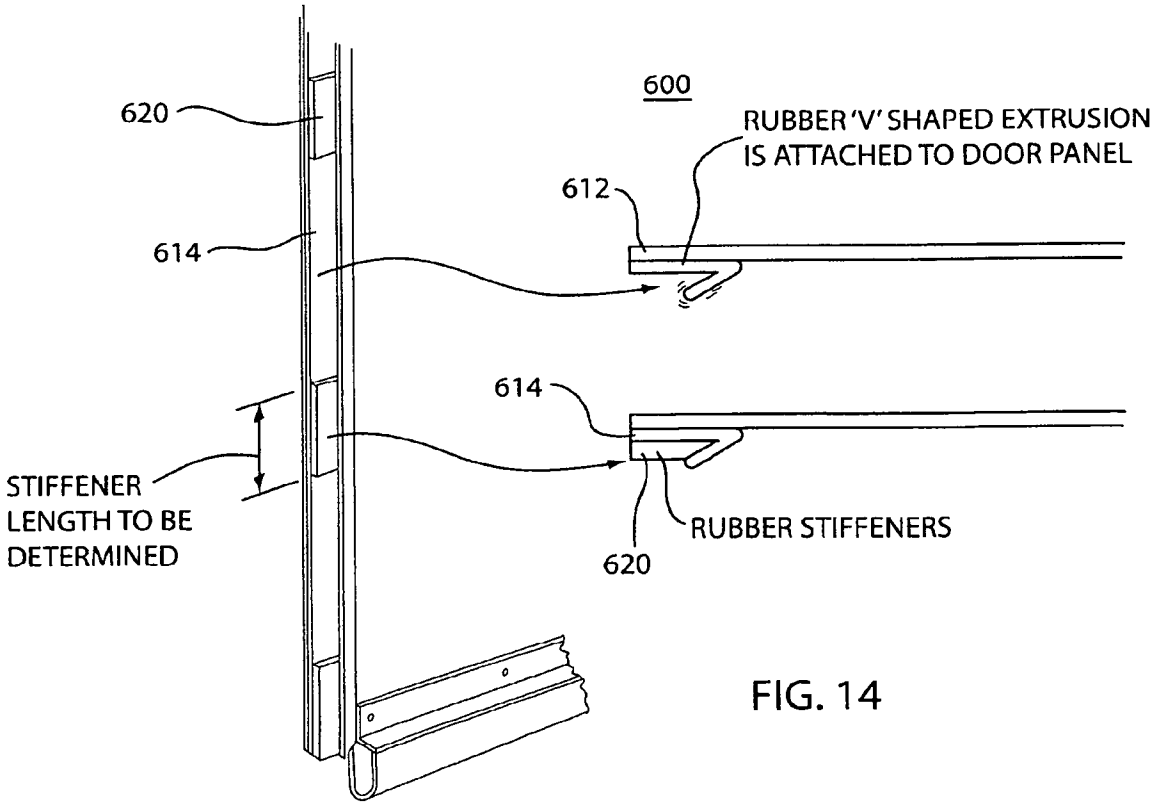
FIG. 14 is a schematic showing a horizontal cross-sectional view of a windlock portion of a door curtain, according to one aspect of the present invention.
Figure 15:
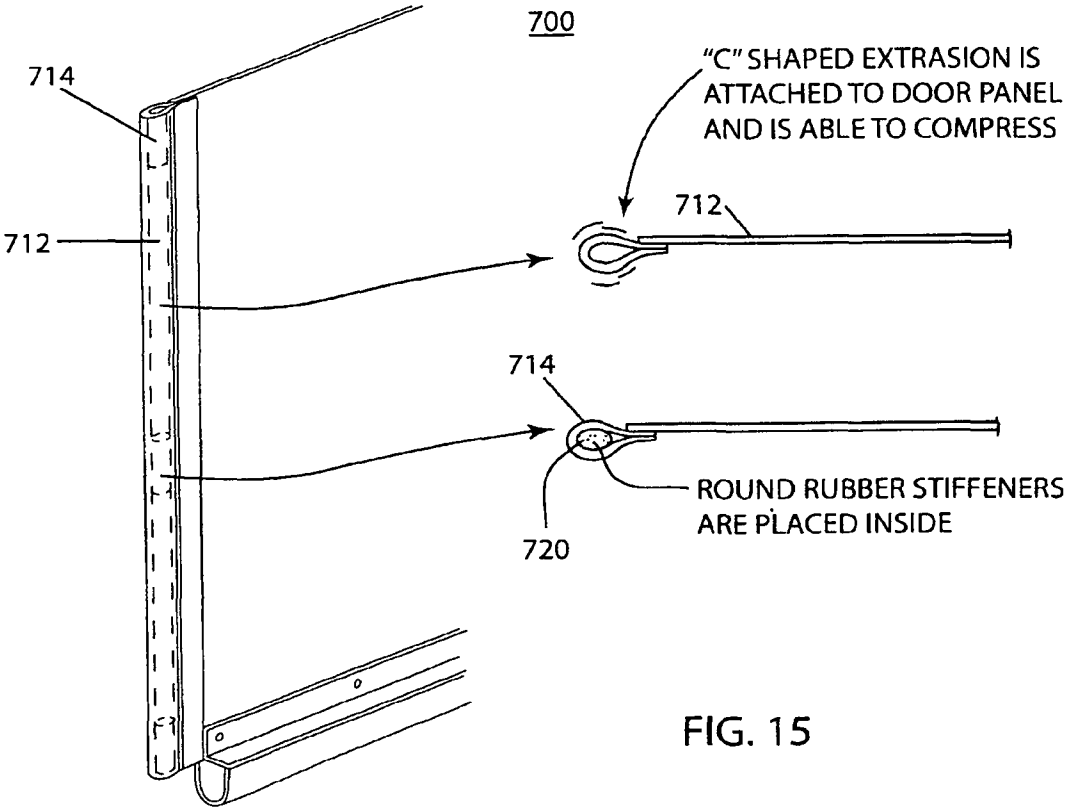
FIG. 15 is a schematic showing a horizontal cross-sectional view of a windlock portion of a door curtain, according to one aspect of the present invention.

Although some embodiments described above include windlocks with sloped edges, the invention is not so limited. For example, the windlocks may be a shaped extrusion of a predetermined shape that may be attached to the door panel. An example of one such windlock 600, according to one aspect of the invention, is shown in FIG. 14, for example. According to this embodiment, door panel 612 may have a SBR or rubber extrusion 614 attached thereto, and the rubber extrusion may be "V" shaped, for example. The extrusion 614 may be continuous or discontinuous along the length of the door panel, and may optionally include rubber stiffeners 620, which can also be continuous or discontinuous. According to another exemplary embodiment shown in FIG. 15, for example, the shaped extrusion 714 may have a "C" shape, for example, which may be partially or fully compressible. As shown in FIG. 15, windlock 700 can also include a round rubber stiffener 720 that may be placed inside this "C" shaped extrusion 714. Again, the shaped extrusion 714 as well as the rubber stiffener 720 may be continuous or discontinuous along the length of the door panel 712. As described in these embodiments, the windlocks profiles may not necessarily be sloped for proper functioning of the present invention. In other words, the windlocks can be round, abruptly stepped at 90 degrees or any other geometry suitable for the purpose of engaging the edge sections of the door panel in the guide channels formed by the angled blades or one-way bearing action described in the above exemplary embodiments.

Similarly, although some embodiments are described with respect to flexible roll-up doors, the invention is not so limited, and the methods, doors, and systems described herein may very well be applied in conjunction with articulated roll-up coverings comprised of lamellae or door leaves.

One advantage of the embodiments described herein is that the door panels can retain wind loads of up to 100 miles/hr. The breakaway release from guide columns is allowed from both sides, i.e. front-to-rear force as well as rear-to-front force. There is no permanent deformation or breakage of components allowed at release from the guide columns. The present invention provides for automatic self-repairing after breakaway release from guide columns. In addition, the present guide system helps retain and enhance architectural aesthetic appearance of the current door systems.

Another advantage is that the instant roll-up door comprises a one-way bearing functionality to the vertical guide system such that the flexible panel with a continuous windlock is allowed to freely travel vertically with minimal resistance, and can provide a continuous vertical seal. The vertical guide assembly provides increasingly heavier resistance to horizontal deflection of the flexible panel and windlock that would dislodge it from the vertical guide in order to retain it in a normal condition under air pressure or impact forces. With excessive forces, the vertical guide allows for release or partial release of the windlock assembly prior to damage occurring to either or any members. In this partially dislodged position, forces resisting vertical movement of the flexible panel are minimized by the allowed deflection of the locking blade, a relatively highly elastic member within the vertical guides, as opposed to the rigid vertical guide or flexible windlock material itself.

Yet another advantage is that the instant roll-up door comprises a one-way bearing that easily allows the flexible panel with continuous windlock to be reinserted, or to reinsert itself into the vertical guide upon vertical motion of the flexible panel with a minimal amount of resistance. This method allows for such a flexible door to provide a high pressure resistance to dislodging from the guides along with a continuous weather seal at the same time as having the ability to repair or heal itself automatically without the need for tools or manual manipulation or disassembly of components. The increasing resistance to pull-out force is achieved by the unidirectional bearing action of the locking blade or elastic member, instead of relying on stiffness or rigidity of the vertical guide itself.

It will be appreciated by those skilled in the construction of roll-up doors that various modifications and changes can be made to the roll-up door of the invention without departing from the spirit and scope of this invention. Accordingly, all such modifications and changes as fall within the scope of the appended claims are intended to be part of this invention.

The invention claimed is:

1. A door comprising:

a flexible sheet forming a curtain for closing a doorway having an upper end, a lower end, and two opposite side edges, said sheet having a relatively thin main area and elongate side edge sections that are thicker than the remainder of said sheet, a shoulder being formed where each side edge section meets said main area;

a curtain winding mechanism having said upper end attached thereto for raising said curtain; and one or more opposing angled blades for forming guide channels in which said side edge sections are respectively movable, said edge sections having a relatively lower surface friction than said main area, wherein the one or more opposing angled blades are held by a gripping bracket so that the blade bends less easily in a first direction and more easily in a second opposing direction, and provide a one way bearing functionality such that the flexible sheet is allowed to freely travel vertically with reduced resistance, and the one or more opposing angled blades are angled toward an inner space of the guide channels, wherein the gripping bracket provides greater resistance to deflection of the blade when the blade is contacted by the shoulder moving in the first direction away from the inner space of the guide channel and less resistance to deflection of the blade when the shoulder is moving in the second direction toward the inner space of the guide channel such that the one way bearing functionality provides increased resistance to horizontal deflection of the flexible sheet, and easily allows the flexible sheet to be reinserted upon dislodging, wherein the door is capable of retaining wind loads of up to 100 mile/hour.

2. A door according to claim 1 wherein said curtain further comprises fabric strips made of one-ply polyester monofilament to reduce friction in said side edge sections.

3. A door according to claim 2 wherein the polyester fabric strips are coated with styrene butadiene rubber on one side, said one side being bonded to the respective side edge section of the curtain.

4. A door according to claim 2 wherein each of said fabric strips is bonded to a respective one of said side edge sections, said fabric strips include at least two fabric strips bonded to the shoulders, and each of said at least two fabric strips has an inner longitudinal section that covers a narrow section of said thin, main area of said sheet and is bonded thereto.

5. A door according to claim 2 wherein each fabric strip has a thickness of about 1.0 mm. and a glossy outer side for engagement with the adjacent guide channel.

6. A door according to claim 1 wherein each fabric strip is a continuous strip extending substantially from said upper end to said lower end of said sheet.

7. A door according to claim 1, wherein the one or more opposing angled blades comprise one or more layers of a single or multi-ply fabric.

8. A door according to claim 7, wherein the one or more layers of a single or multi-ply fabric are coated with rubber or a polymer on one or both sides.

9. A door according to claim 1, wherein the side edges of the curtain form windlocks.

10. A door according to claim 9, wherein the windlocks are continuous or discontinuous along the side edges of the curtain.

11. A door comprising:

a flexible sheet forming a curtain for closing a doorway having an upper end, a lower end, and two opposite side edges, said sheet having a relatively thin main area and elongate side edge sections that are thicker than the remainder of said sheet, a shoulder being formed where each said edge section meets said main area;

a curtain winding mechanism having said upper end attached thereto for raising said curtain;

one or more opposing angled blades for forming guide channels in which said side edge sections are respectively movable, said side edge sections being engageable respectively with said guide channels, wherein the one or more opposing angled blades are held by a gripping bracket and so that the blade bends less easily in a first direction and more easily in a second opposing direction provide a one way bearing functionality such that the flexible sheet is allowed to freely travel vertically with reduced resistance, and the one or more opposing angled blades are angled toward an inner space of the guide channels, wherein the gripping bracket provides greater resistance to deflection of the blade when the blade is contacted by the shoulder moving in the first direction away from the inner space of the guide channel and less resistance to deflection of the blade when the shoulder is moving in the second direction toward the inner space of the guide channel such that the one way bearing functionality provides increased resistance to horizontal deflection of the flexible sheet, and easily allows the flexible sheet to be reinserted upon dislodging, wherein the door is capable of retaining wind loads of up to 100 mile/hour.

12. A door according to claim 11 wherein said flexible sheet is made of vinyl or styrene butadiene rubber.

13. A door according to claim 11 wherein a rigid bottom bar is attached to said lower end of the curtain, said bottom bar is formed with a number of elongate cavities for receiving a number of weights, and weights are mounted in said cavities in order to adjust the total weight of the bottom bar to a desired weight.

14. A door according to claim 11, wherein the one or more opposing angled blades comprise one or more layers of a single or multi-ply fabric.

15. A door according to claim 11, wherein the side edges of the curtain form windlocks.

16. A door comprising:

a vertically movable curtain for closing a doorway, said curtain having an upper end, a lower end, and side edges, said curtain having a relatively thin main area and a thicker strip along a substantial length of each side edge with each strip forming a windlock, a shoulder being formed where each strip meets said main area;

a curtain winding mechanism having said upper end attached thereto for raising and lowering said curtain; and a curtain guide system including one or more opposing angled blades for forming guide channels in which said side edge sections are respectively movable, said side edge sections being engageable respectively with said guide channels, wherein the one or more opposing angled blades are held by a gripping bracket so that the blade bends less easily in a first direction and more easily in a second opposing direction and provide a one way bearing functionality such that the curtain is allowed to freely travel vertically with reduced resistance, and the one or more opposing angled blades are angled toward an inner space of the guide channels, wherein the gripping bracket provides greater resistance to deflection of the blade when the blade is contacted by the shoulder moving in the first direction away from the inner space of the guide channel and less resistance to deflection of the blade when the shoulder is moving in the second direction toward the inner space of the guide channel such that the one way bearing functionality provides increased resistance to horizontal deflection of the curtain, and easily allows the curtain to be reinserted upon dislodging, wherein the door is capable of retaining wind loads of up to 100 mile/hour.

17. A door according to claim 16 wherein at least one of said fabric strips covers each shoulder, which is formed by the elongate styrene butadiene rubber member, and other of said fabric strips are bonded to a side of said curtain which is opposite the side to which the elongate styrene butadiene rubber members are bonded.

18. A door according to claim 17 wherein each fabric strip has a maximum thickness of about 1.0 mm. and a glossy outer side for engagement with the adjacent guide channel.

19. A door according to claim 17 wherein each shoulder slopes outwardly away from the transverse centre of the curtain at an angle ranging between about 30 to about 45 degrees to said main area of the curtain.

20. A door according to claim 17 wherein said fabric strips are bonded to both sides of said curtain at said side edges.

21. A door according to claim 17 wherein said fabric strips covering the shoulders form a long, substantially continuous, friction-reducing surface extending lengthwise along each shoulder.

22. A door according to claim 17 wherein said fabric strips are made of one-ply monofilament fabric that is coated with styrene butadiene rubber on one side, said one side being the side bonded to the side edge of the curtain.

23. A door according to claim 22 wherein said fabric strips covering the shoulders each extend substantially continuously from said upper end of said curtain to said lower end thereof.

24. A door according to claim 17 wherein said fabric strips are made of one-ply monofilament fabric that is coated with styrene butadiene rubber on one side, said one side being the side bonded to the side edge of the curtain.

25. A door according to claim 17 wherein each shoulder slopes outwardly away from the transverse centre of the curtain at an angle of about 45 degrees to said main area of the curtain.

26. A door according to claim 16, wherein the door is a roll-up door with a flexible sheet, lamellae or door leaves.

27. A door according to claim 16, wherein the one or more opposing angled blades comprise one or more layers of a single or multi-ply fabric.

28. A door according to claim 16, wherein the curtain comprises windlocks along the side edges of the curtain.

* * * * *